US009528323B2

(12) United States Patent
Adam

(10) Patent No.: US 9,528,323 B2
(45) Date of Patent: Dec. 27, 2016

(54) FLUID DRILLING HEAD WITH SLIDING GAUGING RING

(75) Inventor: Scott Christopher Adam, Pinjarra Hills (AU)

(73) Assignee: CMTE DEVELOPMENT LIMITED, Pinjarra Hills, Queensland (AU)

( * ) Notice: Subject to any disclaimer, the term of this patent is extended or adjusted under 35 U.S.C. 154(b) by 660 days.

(21) Appl. No.: 13/985,713

(22) PCT Filed: Feb. 23, 2012

(86) PCT No.: PCT/AU2012/000167

§ 371 (c)(1),
(2), (4) Date: Aug. 15, 2013

(87) PCT Pub. No.: WO2012/113023

PCT Pub. Date: Aug. 30, 2012

(65) Prior Publication Data

US 2014/0000967 A1 Jan. 2, 2014

(30) Foreign Application Priority Data

Feb. 25, 2011 (AU) ..... 2011900672

(51) Int. Cl.
*E21B 7/18* (2006.01)
*E21B 10/60* (2006.01)

(52) U.S. Cl.
CPC *E21B 7/18* (2013.01); *E21B 10/60* (2013.01)

(58) Field of Classification Search
CPC ..... E21B 7/18; E21B 10/18; E21B 10/60; E21B 10/61
See application file for complete search history.

(56) References Cited

U.S. PATENT DOCUMENTS 4,106,577 A 8/1978 Summers
4,175,626 A 11/1979 Tummel
(Continued)

FOREIGN PATENT DOCUMENTS

CN 1451839 A 10/2003
CN 1776185 A 5/2006
(Continued)

OTHER PUBLICATIONS

The Second Office Action from related 201280010556.8 dated Mat 27, 2015, with English language translation, 17 pages.
(Continued)

*Primary Examiner* — David Bagnell
*Assistant Examiner* — Abraham Laws
(74) *Attorney, Agent, or Firm* — Barnes & Thornburg LLP

(57) ABSTRACT

A fluid drilling head for drilling a bore hole through rock. The fluid drilling head has a rotatable nozzle assembly incorporating a plurality of nozzles arranged to form fluid jets when provided with a supply of drilling fluid under pressure. The fluid jets include pilot jets directed in the general direction of movement of the drilling head and reaming jets directed generally radially and arranged to enlarge the initial hole formed by the pilot jets. A gauging ring is located behind the cutting head and sized to the intended diameter of the bore hole. The gauging ring is arranged to slide axially relative to the rotating cutting head between a rearward position where the reaming jets are exposed, and a forward position where some or all of the reaming jets are shrouded by the gauging ring and inhibited from enlarging the diameter of the bore hole.

18 Claims, 3 Drawing Sheets

(56) References Cited

U.S. PATENT DOCUMENTS

| | | | | |
|---|---|---|---|---|
| 4,227,582 | A * | 10/1980 | Price | E21B 7/15 166/297 |
| 4,649,732 | A * | 3/1987 | Molina | B25B 27/0007 29/243.529 |
| 5,199,512 | A | 4/1993 | Curlett | |
| 6,189,629 | B1 * | 2/2001 | McLeod | E21B 7/061 175/321 |
| 2005/0034901 | A1 * | 2/2005 | Meyer | E21B 10/60 175/393 |

FOREIGN PATENT DOCUMENTS

| | | |
|---|---|---|
| CN | 101413380 | 4/2009 |
| CN | 101413380 A | 4/2009 |
| WO | 03042491 A1 | 5/2003 |
| WO | WO03/042491 | 5/2003 |

OTHER PUBLICATIONS

English translation of the First Office Action issued by the Intellectual Property Office of China, Nov. 3, 2014, 6 pages.
First Office Action issued by the Intellectual Property Office of China, Nov. 3, 2014, 5 pages.
PCT Search Report for PCT/AU2012/000167 completed Mar. 16, 2012.

* cited by examiner

FLUID DRILLING HEAD WITH SLIDING GAUGING RING

CROSS-REFERENCE TO RELATED APPLICATIONS

This application is the U. S. national phase of PCT/AU2012/000167 filed Feb. 23, 2012. PCT/AU2012/000167 claims priority to Australian Patent Application Serial No. 2011900672 filed Feb. 25, 2011. The entire disclosures of Australian Patent Application Serial No. 2011900672 and PCT/AU2012/000167 are hereby incorporated herein by reference.

FIELD OF THE INVENTION

This invention relates to a fluid drilling head with a sliding gauging ring and has been devised particularly though not solely for use in fluid drilling apparatus of the type described in our International Patent Specification No. PCT/AU02/01550, under International publication No. WO 03/042491 A1, the content of which is incorporated herein by way of cross reference.

BACKGROUND OF THE INVENTION

In fluid drilling apparatus of the type described in PCT/AU02/01550, it is known to use a gauging ring sized so that the outer diameter of the ring approximates the desired size of the bore hole to be drilled, to control the forward movement of the fluid drilling head through the rock. In the example given in this PCT specification, the gauging ring is spaced from the rotatable nozzle assembly of the drilling head so that chips of rock cut or burst loose by the action of the fluid jets in the rotatable drilling head can pass between the gauging ring and the body of the drilling head to be flushed rearwardly with the return drilling fluid from the pilot jets and reaming jets.

It has been found important to maintain the velocity of the drilling fluid flowing back through the bore hole to avoid the formation or build up of a bed of cuttings in the bore hole which significantly increases the friction between the hose and the walls of a lateral bore hole.

Compared to conventional drilling systems, the thrust forces involved in fluid jet drilling are very low. The drilling head is typically propelled forward by retrojets of drilling fluid from the drilling head with a relatively low thrust force. The hose based system precludes the application of significant "push" which could otherwise be provided by coiled tubing used in other forms of drilling head, as any push of this nature simply helically buckles the hose in the bore hole creating added friction and resistance to forward movement of the drilling head.

It has been demonstrated that the friction between the hose and the lateral bore hole increases many fold when the hose is partially submerged in cuttings being flushed back down the bore hole from the drilling head. It is most desirable for the hose to be in a clean bore hole as the high friction in the hole negates the forward thrust very quickly and restricts the length to which a bore hole can be drilled using a fluid drilling head.

In order to keep the velocity of the fluid flowing in a lateral bore hole high enough to entrain the cuttings and prevent formation or build up of a bed of cuttings in the lateral hole, the fluid velocity must be kept above a critical level in order to entrain the chips or cuttings.

It has been found that fluid drilling heads with gauging rings of the type described in international patent specification PCT/AU02/01550, while useful in preventing the drilling head becoming jammed in the hole through excessively rapid movement, can cause the forward progress of the drill to slow down or stall while the pilot jets cut their way through patches of hard rock or deal with other obstructions. In this situation, the reaming jets continue to enlarge the bore hole diameter and rapidly cut a larger diameter hole than the gauging ring. This large diameter hole results in a slowing of the velocity of the return drilling fluid which in turn leads to a build up of the cuttings bed in the base of the lateral bore hole and increased frictional drag on the hose. Once the friction drag on the hose increases beyond the base level, the tool will not feed at the optimal rate under any circumstance and will proceed drilling a large bore hole. This usually is associated with severe doglegs both horizontally and vertically and the subsequent termination of the lateral bore hole.

SUMMARY OF THE INVENTION

The present invention therefore provides a fluid drilling head for drilling a bore hole through rock, said fluid drilling head having a rotatable nozzle assembly incorporating a plurality of nozzles arranged to form fluid jets when provided with a supply of fluid under pressure, said fluid jets including one or more pilot jets directed in the general direction of movement of the fluid drilling head and one or more reaming jets directed generally radially and arranged to enlarge the initial hole formed by the pilot jets, and a gauging ring located behind the rotatable nozzle assembly cutting head and sized to the intended diameter of the bore hole, said gauging ring being arranged to slide axially relative to the rotatable nozzle assembly rotating cutting head between a rearward position where the or each reaming jet is exposed, and a forward position where some or all of the reaming jets are shrouded by the gauging ring so as to be inoperable beyond a point of obstruction by the gauging ring.

Preferably biasing means are provided arranged to bias the gauging ring into the forward position.

Preferably, the biasing means comprise a spring.

Alternatively, the biasing means comprise hydraulic force from the supply of drilling fluid under pressure acting against rearward facing surfaces on the gauging ring.

In some forms of the invention the biasing means may be a combination of a spring and hydraulic force.

BRIEF DESCRIPTION OF THE DRAWINGS

Notwithstanding any other forms that may fall within its scope, one preferred form of the invention will now be described by way of example only, with reference to the accompanying drawings, in which.

DETAILED DESCRIPTION OF PREFERRED EMBODIMENTS OF THE INVENTION

Figure 1:
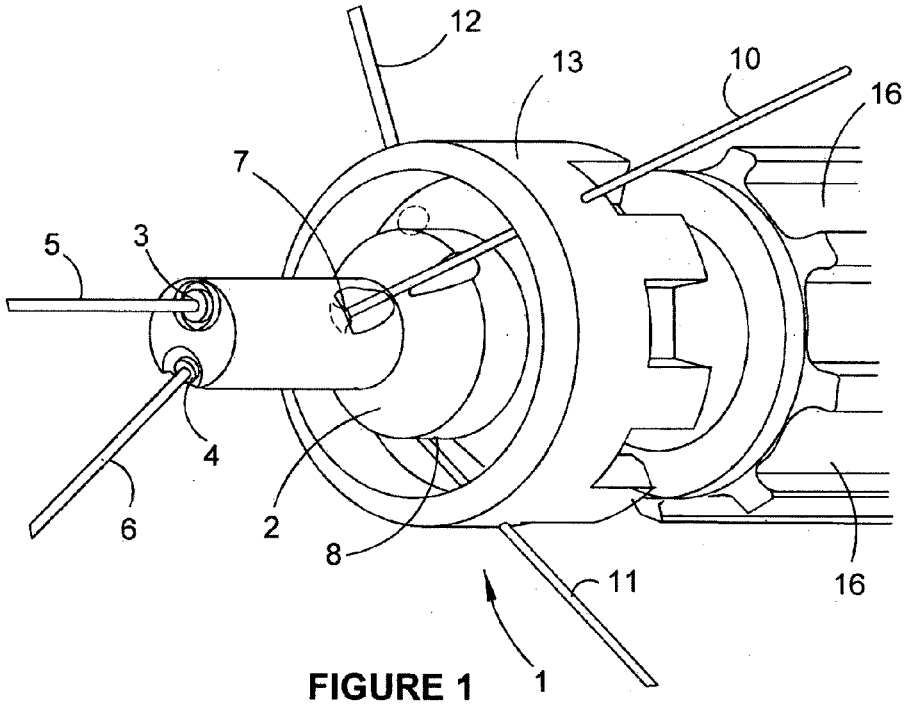
FIG. 1 is a general perspective view of a fluid drilling head according to the invention.

In the preferred form of the invention, a fluid drilling head 1 is formed from a rotatable nozzle assembly 2 having nozzles 3 and 4 from which issue high pressure pilot jets of drilling fluid (typically water) 5 and 6 respectively.

The rotatable nozzle assembly also incorporates reaming nozzles 7, 8 and 9 from which issue reaming water jets 10, 11 and 12 respectively.

The trajectory of the fluid jets is shown in the accompanying drawings in an idealised way as slender rods emanating from each nozzle, and further these rods are shown extending through the gauging ring (to be described further later) for clarity of their direction, even though in practice they may be shrouded or obstructed by the gauging ring.

Figure 3:
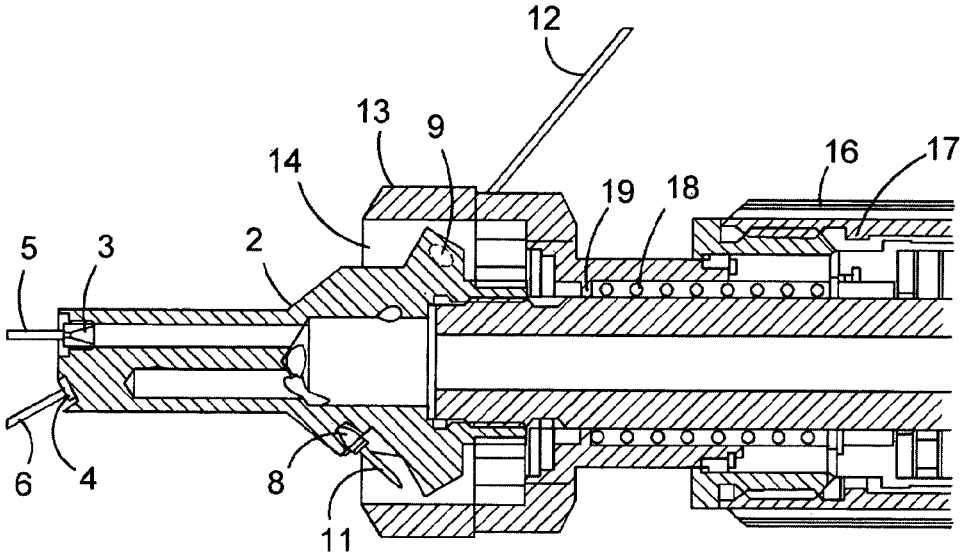
FIG. 3 is a cross-sectional view of the fluid drilling head shown in FIG. 1, with the gauging ring shown in the forward position so as to shroud all of the reaming jets.
Figure 4:
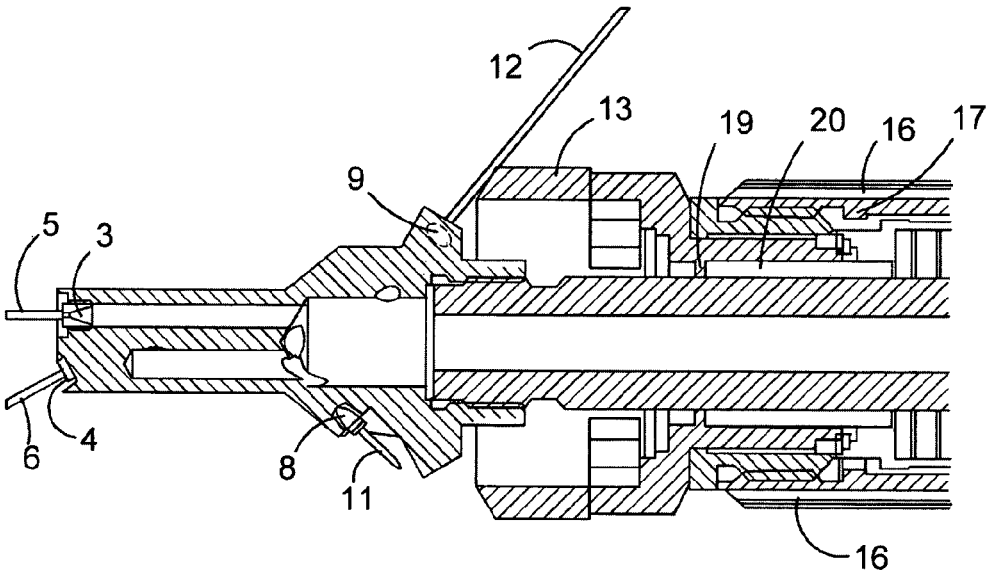
FIG. 4 is a similar view to FIG. 3, showing the gauging ring in the rearward position, with all of the reaming jets exposed.

The fluid drilling head is provided with a gauging ring 13 having an overall diameter slightly smaller than the intended diameter of the bore hole to be drilled and the gauging ring is mounted on the fluid drilling head so as to be arranged to slide axially relative to the rotatable nozzle assembly 2 between a rearward position as shown in FIG. 4 where the reaming jets 10, 11 and 12 are all exposed, and a forward position as shown in FIG. 3, where the reaming jets are shrouded or covered by the gauging ring so as to be inoperable beyond the point of obstruction by the gauging ring. The reaming jet may extend radially from the fluid drilling head but are preferably angled rearwardly as shown in the drawings.

The gauging ring is adapted to receive a flow of drilling fluid and cuttings issuing from the action of the various jets through an annular aperture 14 between the ring and the body of the cutting head and allow those cuttings to pass rearwardly through openings 15 in the trailing edge of the gauging ring where they can pass down the body of the fluid drilling head through channels 16 in the body 17 of the drilling head.

The sliding gauging ring is biased into the forward position as shown in FIG. 3 by a biasing means which may be either a spring 18 bearing against a rearward facing shoulder 19 of the gauging ring as can be seen in FIG. 3 or alternatively by fluid pressure provided from the high pressure drilling fluid supplied through the hose of the drilling head into cavity 20 which again bears against the shoulder 19 as shown in FIG. 4.

In use, as the fluid drilling head moves forward in the bore hole, the gauging ring 13 will eventually contact the end of the hole where the pilot jets 5 and 6 have only yet cut a relatively small diameter hole. At this point, the gauging ring will be unable to move forward due to the surrounding rock, but the rest of the tool will be free to continue to move forward against the action of either the spring 18 or the hydraulic chamber 20. The configuration of the biasing means can be carefully selected to allow the required rate of forward movement of the tool relative to the gauging ring.

As the tool moves forward relative to the gauging ring, it reaches the position shown in FIG. 4 where all of the reaming jets 10, 11 and 12 are exposed, allowing the reaming jets to enlarge the bore hole until the diameter of the bore hole exceeds the diameter of the gauging ring. The gauging ring then begins to move forward under the biasing action of the spring 18 or the hydraulic chamber 20 through the position shown in FIG. 2 where the rearmost reaming jet 12 is covered or shrouded by the gauging ring, and if necessary, to the extreme position shown in FIG. 3 where the gauging ring is all the way forward with all of the reaming jets 10, 11 and 12 covered or shrouded.

Once in the position shown in FIG. 3, the action of the pilot jets 5 and 6 again becomes dominant allowing the rotating cutting head to move forward and again causing the gauging ring to be obstructed by the narrower diameter bore hole and moved rearwardly.

Figure 2:
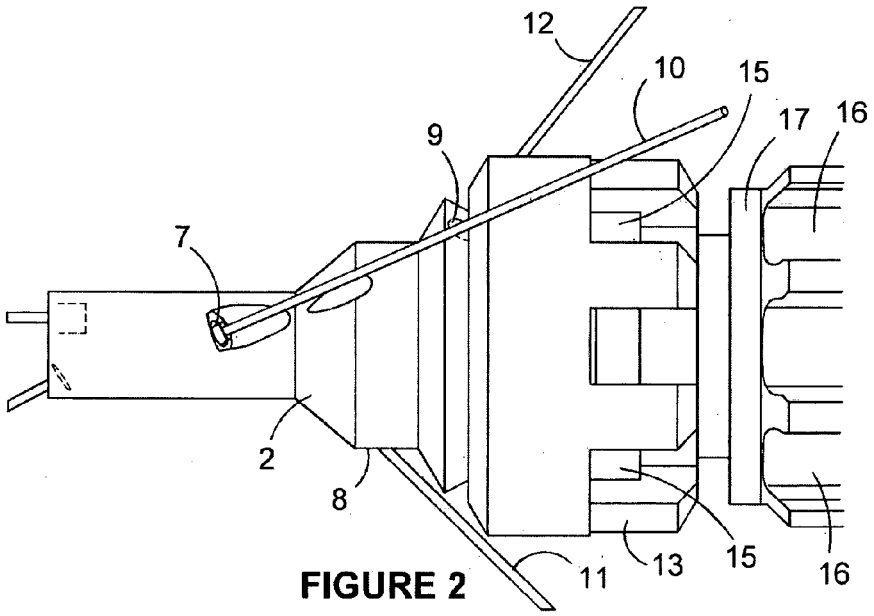
FIG. 2 is a side view of the fluid drilling head shown in FIG. 1, with the gauging ring in a medium position obstructing the rearmost reaming jet.

In medium drilling conditions, the gauging ring is likely to sit in a balanced situation as shown in FIG. 2, but in easy drilling conditions, the gauging ring will typically move all the way forward to the position shown in FIG. 3 allowing the pilot jets 5 and 6 to continue the elongation of the hole without the action of the reaming jets causing the hole to become oversized in diameter and the flow rate of the return water entraining the cutting jets, reduced.

Figure 5:
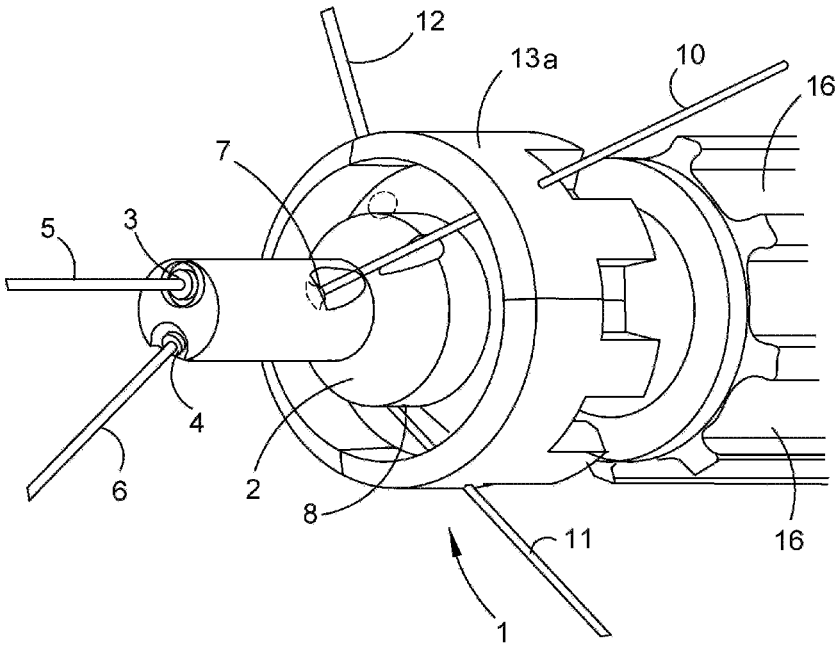
FIG. 5 is a general perspective view of an alternative fluid drilling head according to the invention having a segmented gauging ring.

It is envisaged that the sliding gauging ring will work well in uniform rock conditions, but in non-uniform strata, such as when the cutting head is running along a stone/coal interface, the gauging ring will be pushed back by the harder material (the stone) and the more easily drilled strata (the coal) will be overdrilled, or overreamed to an excessive diameter. It is envisaged that further embodiments of this invention as shown in FIG. 5 may be developed wherein the gauging ring 13*a* is segmented around its circumference so that each segment can operate independently of the adjacent segments to overcome this problem.

In this manner, a fluid drilling head is provided which will enable a bore hole of much more even diameter than has hitherto been possible to be bored through rock and coal or other strata of varying densities. The use of the sliding gauging ring obviates the need for very high feed rates of the drilling fluid and excessively careful nozzle selection which are currently the only way to attempt to control bore hole diameter. By carefully controlling the bore hole diameter and therefore keeping the return flow rate of the fluid through a lateral bore hole high, the build up of a cuttings bed in the base of the lateral is obviated and friction drag on the hose is reduced. This allows bore holes to be drilled to much greater length than has hitherto been possible with conventional fluid drilling heads.

The invention claimed is:

1. A fluid drilling head for drilling a bore hole through rock, said fluid drilling head having:

a rotatable nozzle assembly incorporating a plurality of nozzles arranged to form fluid jets when provided with a supply of fluid under pressure, said fluid jets including one or more pilot jets directed in the general direction of movement of the fluid drilling head and one or more reaming jets directed generally radially and arranged to enlarge the initial hole formed by the pilot jets, and a gauging ring located behind the rotatable nozzle assembly and sized to the intended diameter of the bore hole, said gauging ring being arranged to slide axially relative to the rotatable nozzle assembly between a rearward position where each reaming jet is exposed, and a forward position where some or all of the reaming jets are shrouded by the gauging ring so as to be inoperable beyond a point of obstruction by the gauging ring.

2. The fluid drilling head as claimed in claim 1, wherein biasing means are provided arranged to bias the gauging ring into the forward position.

3. The fluid drilling head as claimed in claim 2, wherein the biasing means comprise a spring.

4. The fluid drilling head as claimed in claim 3 wherein one or more of the reaming jets are angled rearwardly.

5. The fluid drilling head as claimed in claim 2, wherein the biasing means comprise hydraulic force from the supply of drilling fluid under pressure acting against rearward facing surfaces on the gauging ring.

6. The fluid drilling head as claimed in claim 5 wherein one or more of the reaming jets are angled rearwardly.

7. The fluid drilling head as claimed in claim 2 wherein the biasing means comprise a combination of a spring and hydraulic force from the supply of drilling fluid under pressure acting against rearwardly facing surfaces on the gauging ring.

8. The fluid drilling head as claimed in claim 7 wherein one or more of the reaming jets are angled rearwardly.

9. The fluid drilling head as claimed in claim 2 wherein one or more of the reaming jets are angled rearwardly.

10. The fluid drilling head as claimed in claim 1 wherein the gauging ring is segmented around its circumference so that each segment can slide axially independently of adjacent segments.

11. The fluid drilling head as claimed in claim 10 wherein one or more of the reaming jets are angled rearwardly.

12. The fluid drilling head as claimed in claim 1 wherein one or more of the reaming jets are angled rearwardly.

13. A fluid drilling head for drilling a bore hole through rock, said fluid drilling head having:

a rotatable nozzle assembly incorporating a plurality of nozzles arranged to form fluid jets when provided with a supply of fluid under pressure, said fluid jets including one or more pilot jets directed in the general direction of movement of the fluid drilling head and one or more reaming jets directed generally radially and arranged to enlarge the initial hole formed by the pilot jets, and a gauging ring located behind the rotatable nozzle assembly and sized to the intended diameter of the bore hole, said gauging ring being arranged to slide axially relative to the rotatable nozzle assembly between a rearward position where each reaming jet is exposed, and a forward position where some or all of the reaming jets are shrouded by the gauging ring, wherein biasing means are provided arranged to bias the gauging ring into the forward position, the biasing means comprising hydraulic force from the supply of drilling fluid under pressure acting against rearward facing surfaces on the gauging ring.

14. The fluid drilling head as claimed in claim 13 wherein one or more of the reaming jets are angled rearwardly.

15. The fluid drilling head as claimed in claim 13 wherein the gauging ring is segmented around its circumference so that each segment can slide axially independently of adjacent segments.

16. A fluid drilling head for drilling a bore hole through rock, said fluid drilling head having:

a rotatable nozzle assembly incorporating a plurality of nozzles arranged to form fluid jets when provided with a supply of fluid under pressure, said fluid jets including one or more pilot jets directed in the general direction of movement of the fluid drilling head and one or more reaming jets directed generally radially and arranged to enlarge the initial hole formed by the pilot jets, and a gauging ring located behind the rotatable nozzle assembly and sized to the intended diameter of the bore hole, said gauging ring being arranged to slide axially relative to the rotatable nozzle assembly between a rearward position where each reaming jet is exposed, and a forward position where some or all of the reaming jets are shrouded by the gauging ring, wherein biasing means are provided arranged to bias the gauging ring into the forward position, the biasing means comprising a combination of a spring and hydraulic force from the supply of drilling fluid under pressure acting against rearwardly facing surfaces on the gauging ring.

17. The fluid drilling head as claimed in claim 16 wherein one or more of the reaming jets are angled rearwardly.

18. The fluid drilling head as claimed in claim 16 wherein the gauging ring is segmented around its circumference so that each segment can slide axially independently of adjacent segments.

* * * * *